US011538391B2

(12) United States Patent
Guo

(10) Patent No.: US 11,538,391 B2
(45) **Date of Patent: *Dec. 27, 2022**

(54) DRIVING METHOD FOR DISPLAY PANEL, DRIVING DEVICE THEREOF AND DISPLAY DEVICE

(71) Applicant: HKC CORPORATION LIMITED, Shenzhen (CN)

(72) Inventor: Dongsheng Guo, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/465,859

(22) Filed: Sep. 3, 2021

(65) Prior Publication Data

US 2021/0398474 A1 Dec. 23, 2021

Related U.S. Application Data

(62) Division of application No. 17/042,913, filed as application No. PCT/CN2018/114711 on Nov. 9, 2018, now Pat. No. 11,151,923.

(51) Int. Cl.
*G09G 3/20* (2006.01)

(52) U.S. Cl.
CPC ..... *G09G 3/2007* (2013.01); *G09G 2310/06* (2013.01); *G09G 2320/0233* (2013.01)

(58) Field of Classification Search
None
See application file for complete search history.

(56) References Cited

U.S. PATENT DOCUMENTS

2007/0046567 A1* 3/2007 Ha ..... G09G 3/3648 345/38
2013/0135267 A1* 5/2013 Jeong ..... G09G 3/3688 345/204
2016/0005767 A1* 1/2016 Shen ..... G02F 1/136286 438/154
2017/0076666 A1* 3/2017 Kawana ..... G09G 3/3266

* cited by examiner

*Primary Examiner* — Matthew Yeung

(57) ABSTRACT

The present application discloses a driving method for a display panel, a driving device thereof and a display device. The driving method includes: performing square wave conversion on drive data received by each channel to obtain data line signals, where square wave signals generated by the conversion of different gray scales in the corresponding drive data have an identical high level, and the time of low level output is different.

4 Claims, 8 Drawing Sheets

DRIVING METHOD FOR DISPLAY PANEL, DRIVING DEVICE THEREOF AND DISPLAY DEVICE

CROSS REFERENCE OF RELATED APPLICATIONS

This application is a Divisional of U.S. patent application Ser. No. 17/042,913 filed on Sep. 29, 2019. The present application claims priority to Chinese Patent Application No. CN201811267616.X, filed to the Chinese Patent Office on Oct. 29, 2018, and entitled "DRIVING METHOD FOR DISPLAY PANEL, DRIVING DEVICE THEREOF AND DISPLAY DEVICE", which is incorporated herein by reference in its entirety.

TECHNICAL FIELD

The present application relates to the technical field of display, and in particular, to a driving method for a display panel, a driving device thereof and a display device.

BACKGROUND

The statements herein merely provide background information related to the present application and do not necessarily constitute the prior art.

With the development and advancement of technology, flat panel displays have become mainstream display products due to their thin bodies, power saving and low radiation, etc., and have been widely used. The flat panel displays include a thin film transistor-liquid crystal display (TFT-LCD), an organic light-emitting diode (OLED) display, and the like. The thin film transistor-liquid crystal display controls a rotation direction of liquid crystal molecules to refract light of a backlight module to produce a picture, and has many advantages such as thin body, power saving, and no radiation. The organic light-emitting diode display is made of organic light-emitting diodes, and has many advantages such as self-illumination, short response time, high definition and contrast, flexible display and large-area full-color display.

In a gray scale control mode of a display panel, digital-to-analog conversion occupies most of the area of a chip, and increases a manufacturing cost of the display panel.

SUMMARY

An objective of the present application is to provide a driving method for a display panel, a driving device thereof and a display device, which can remove digital-to-analog conversion and also control gray scale values.

To achieve the above objective, the present application provides a driving method for a display panel, which includes steps of: receiving drive data corresponding to each channel; performing square wave conversion on the drive data to obtain data line signals; outputting the data line signal corresponding to each channel, and transmitting the data line signal to a corresponding data line on the display panel; and performing data driving on the display panel, where in the step of performing square wave conversion on the drive data to obtain data line signals, square wave signals generated by the conversion of different gray scales in the corresponding drive data have an identical high level, and the time of low level output is different.

The present application also discloses a driving device for a display panel, which includes: a receiver that receives drive data corresponding to each channel; a square wave conversion chip that performs square wave conversion on the drive data to obtain data line signals; and an outputter that outputs the data line signal corresponding to each channel, transmits the data line signal to a corresponding data line on the display panel, and performs data driving on the display panel; where in the square wave conversion chip, square wave signals generated by the conversion of different gray scales in the corresponding drive data have an identical high level, and the time of low level output is different.

The present application also discloses a display device, which includes: a display panel and the above-mentioned driving device, where after receiving a set of data signals, the driving device outputs a set of data line signals by conversion, and transmits the set of data line signals to a set of corresponding data lines on the display panel; and the driving device controls a display state of the display panel and performs data driving on the display device.

In a solution, different levels are obtained by digital-to-analog conversion, i.e., high levels of generated signals are different, while the high level duration is the same, to achieve the purpose of data driving, and a digital-to-analog conversion circuit used in the digital-to-analog conversion method is complicated and occupies a large area of a chip. Compared with the solution, in the present application, not a digital-to-analog conversion method but a square wave conversion method is adopted, i.e., generated square wave signals have an identical high level, while the time of low level output is different. The high level in the adopted square wave conversion method is constant and can be controlled by only a set of maximum voltage across reference voltages, which greatly lowers the design requirements for a peripheral circuit, saves the area of the chip, and saves a production cost of the display panel; there is no need to change the high level value, and only the time of low level output needs to be controlled, making operations easier; during the actual operation, the level may be first a high level and then a low level; first charging is performed to implement a voltage that exceeds a required voltage, and then discharging is performed to implement the required voltage through the low level discharging.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
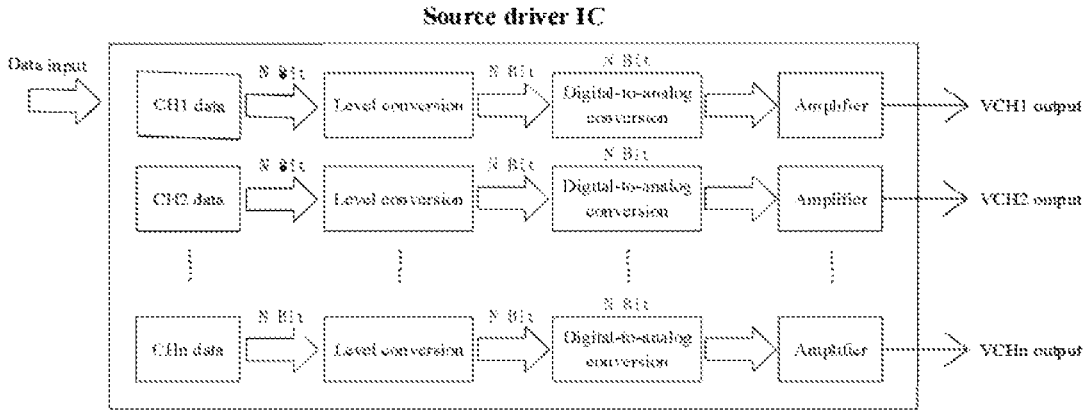
FIG. 1 is a schematic view of driving of a display panel according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms "first", "second" are merely for a descriptive purpose, and cannot to be understood to indicate or imply a relative importance, or implicitly indicate the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

A method known to the inventors is as follows: In a mode of controlling a liquid crystal display panel to display various gray scales, the display of the brightness is controlled mainly depending on the magnitude of a voltage, and the voltage corresponding to each data needs digital-to-analog conversion (DAC) processing inside a source driver. However, the DAC occupies the vast majority of an area design of a source driver IC of the source driver. As shown in FIG. 1, an internal architecture of an undisclosed source driver IC is provided. After data receival of each channel (CH1, CH2 . . . CHn), it is necessary to perform level shift → DAC → amplification by an operational amplifier (OP) to generate an output voltage of each channel (VCH1, VCH2 . . . VCHn), where the DAC is the part occupying larger area, and an analog circuit for the DAC is designed; and the larger the N bits of the data, the larger the area.

Figure 2A:
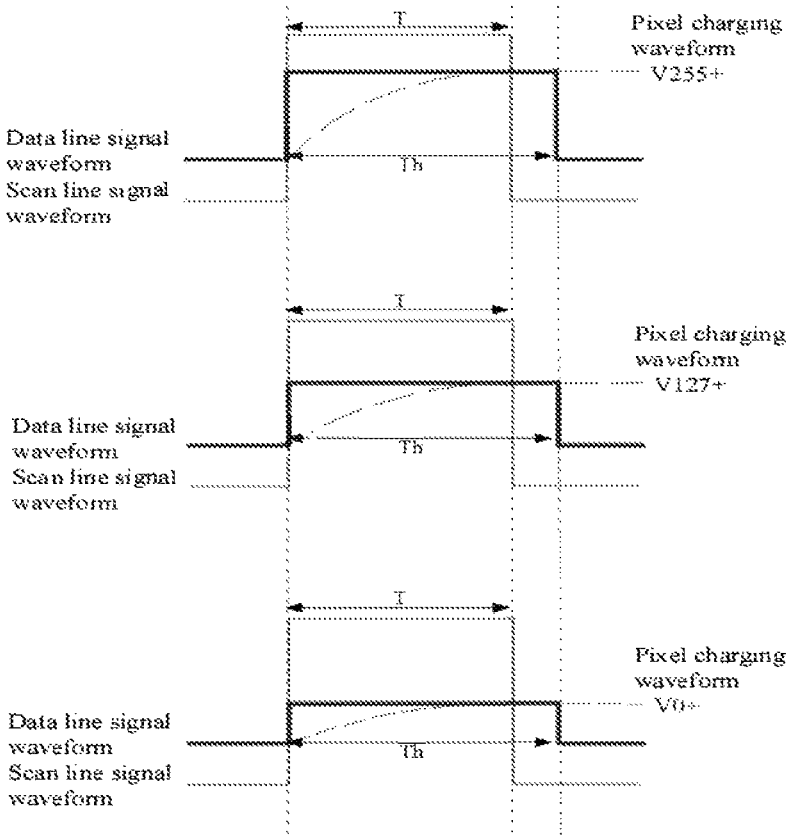
FIGS. 2*a-b* are schematic views showing pixel charging waveforms of a display panel according to an embodiment of the present application.
Figure 2B:
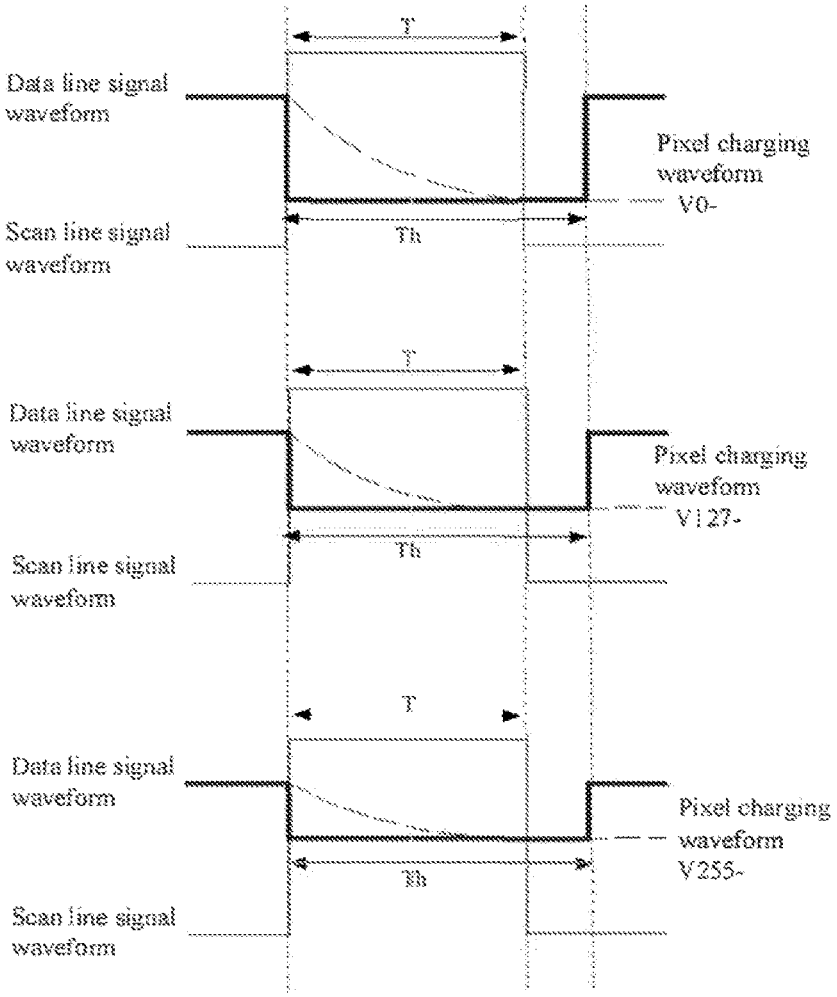
Figure 3:
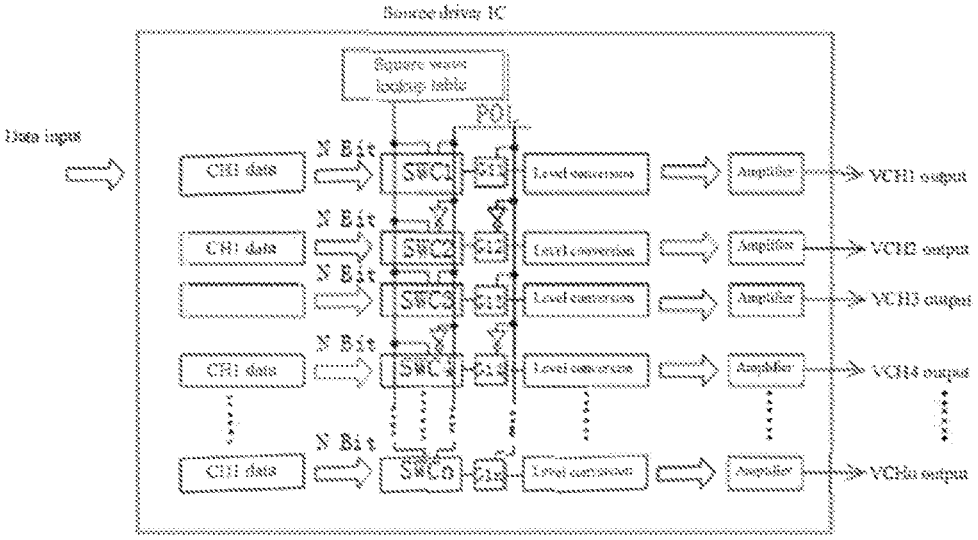
FIG. 3 is a schematic view of driving of another display panel according to an embodiment of the present application.
Figure 4A:
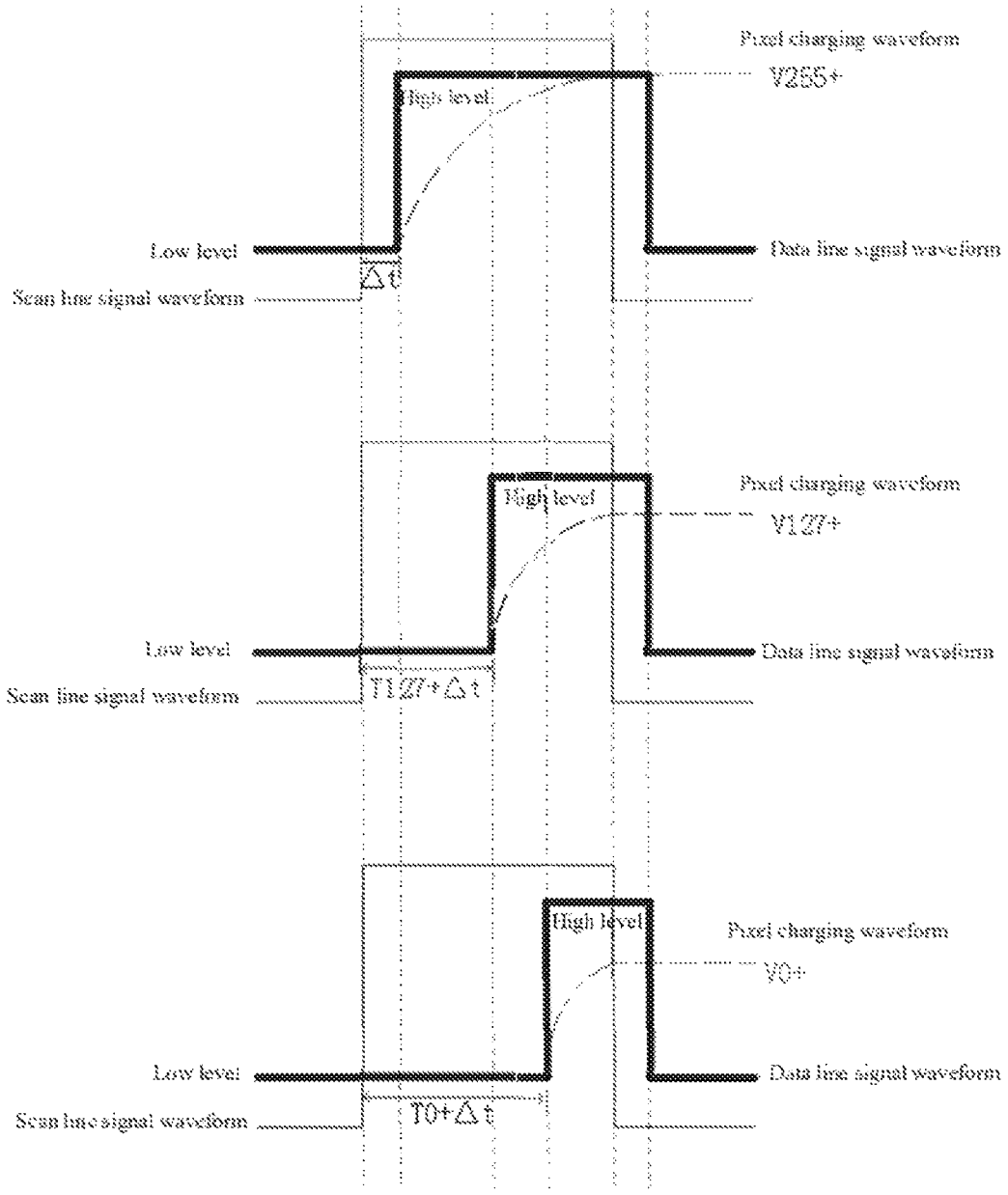
FIGS. 4*a-b* are schematic views showing pixel charging waveforms of another display panel according to an embodiment of the present application.
Figure 4B:
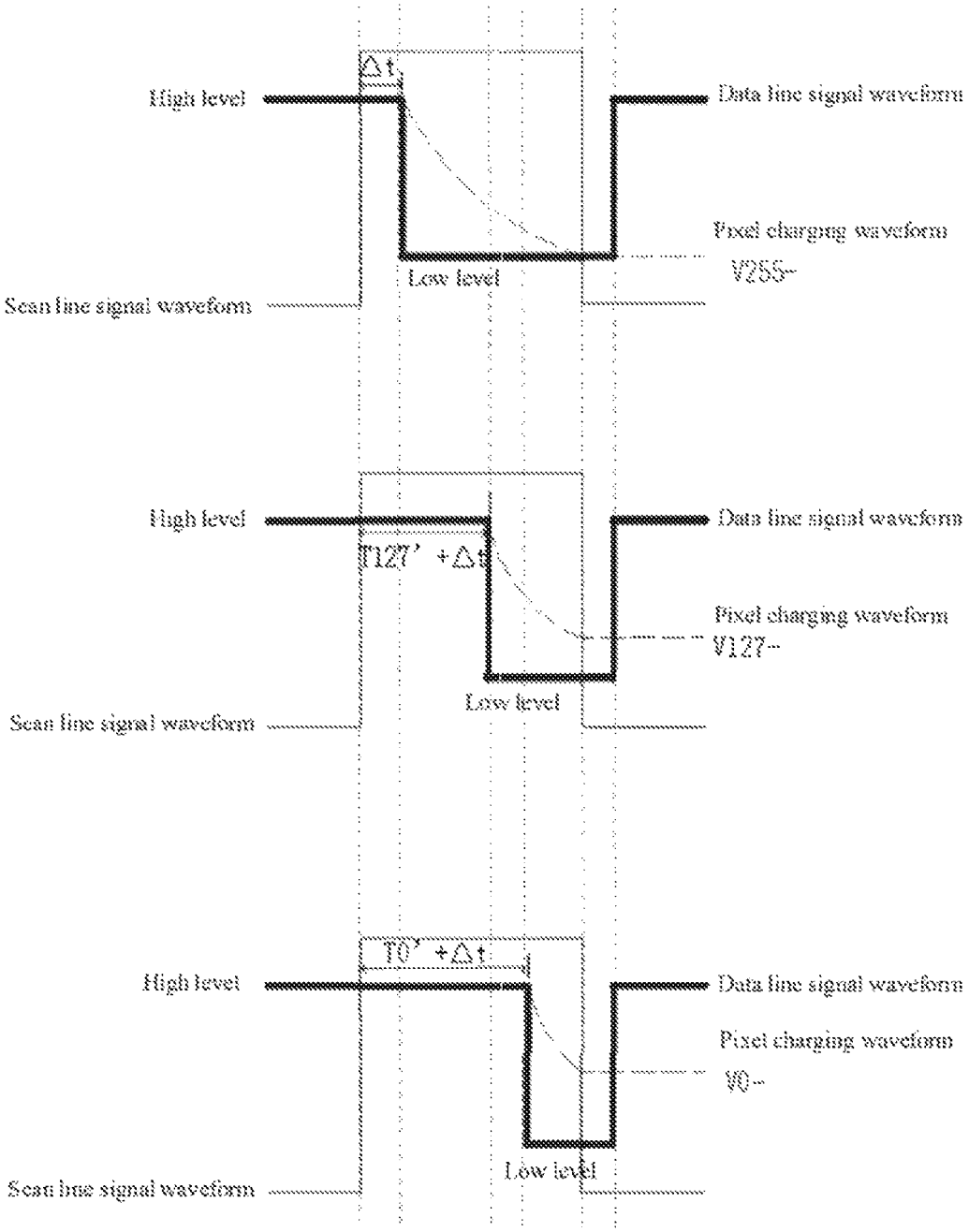

As shown in FIGS. 2*a-b*, taking an 8-bit display as an example, T is the charging time of each row of pixels, and This the total time of one row, and is determined by the output of a scan line. When the source chip outputs a voltage waveform corresponding to 0-255 gray scale, a charging waveform of a corresponding pixel is as shown in the figure, and during pixel charging, there will be a certain time for the change of the pixel voltage.

The present application will be further described below with reference to the accompanying drawings and optional embodiments.

As shown in FIG. 3 to FIG. 8, an embodiment of the present application discloses a driving method for a display panel, including steps: S81: Receive drive data corresponding to each channel. S82: Perform square wave conversion on the drive data to obtain data line signals. S83: Output the data line signal corresponding to each channel, and transmit the data line signal to a corresponding data line on the display panel; and perform data driving on the display panel.

In the step of performing square wave conversion on the drive data to obtain data line signals, square wave signals generated by the conversion of different gray scales in the corresponding drive data have an identical high level, and the time of low level output is different.

In a solution, different levels are obtained by digital-to-analog conversion, i.e., high levels of generated signals are different, while the time of low level output is the same, to achieve the purpose of data driving, and a digital-to-analog conversion circuit used in the digital-to-analog conversion method is complicated and occupies a large area of a chip. Compared with the solution, in the present application, not a digital-to-analog conversion method but a square wave conversion method is adopted, i.e., generated square wave signals have an identical high level, while the time of low level output is different. The high level in the adopted square wave conversion method is constant and can be controlled by only a set of maximum voltage across reference voltages, which greatly lowers the design requirements for a peripheral circuit, saves the area of the chip, and saves a production cost of the display panel; there is no need to change the high level value, and only the time of low level output needs to be controlled, making operations easier; during the actual operation, the level may be first a high level and then a low level; first charging is performed to implement a voltage that exceeds a required voltage, and then discharging is performed to implement the required voltage through the low level discharging.

In an embodiment, in the step of performing square wave conversion on the drive data to obtain data line signals, a high level and a low level on the same data line corresponding to two adjacent scan lines have reversed starting orders.

In this solution, the high and low levels on the data line have reversed starting orders. Therefore, on the same data line, if a data line signal corresponding to the time when a previous row of scan lines is driven is first a high level and then a low level, the data line signal corresponding to the time when a current row of scan lines is driven is first a low level and then a high level; if the data line signal corresponding to the time when the previous row of scan lines is driven is first a low level and then a high level, the data line signal corresponding to the time when the current row of scan lines is driven is first a high level and then a low level; the signal on the same data line is between the corresponding two adjacent scan lines, and high levels are together, and low levels are together; when the signal on the data line corresponding to the two adjacent rows of scan lines is switched at the scan lines, a direction of a level does not need to be changed; there is no voltage across the corresponding two adjacent scan lines, and levels are both high levels or low levels, and a level change frequency is reduced by a half. Therefore, the power consumption of the data lines can be significantly reduced, and heat generated when the data line works is slowed down; and at the same time, the interference between the data line and other signal lines is reduced.

In an embodiment, in the step of performing square wave conversion on the drive data to obtain data line signals, a high level and a low level on the same data line corresponding to two adjacent scan lines have the same starting order.

In this solution, the high level and the low level on the data line have the same starting order. If a data line signal corresponding to the time when a previous row of scan lines is driven is first a high level and then a low level, the data line signal corresponding to the time when a current row of scan lines is driven is also first a high level and then a low level; if the data line signal corresponding to the time when the previous row of scan lines is driven is first a low level and then a high level, the data line signal corresponding to the time when the current row of scan lines is driven is also first a low level and then a high level; and the level between the two adjacent scan lines needs to be across the voltage, so that the brightness of the display panel is uniform.

In an embodiment, in the step of performing square wave conversion on the drive data to obtain data line signals, a high level and a low level on two adjacent data lines corresponding to the same scan line have reversed starting orders.

In this solution, the high level and the low level on the data lines have reversed starting orders. Corresponding to the same scan line, if the data line signal of the previous column corresponding to the time when the current scan line is driven is first a high level and then a low level, the data line signal of the current column corresponding to the time when the current scan line is driven is first a low level and then a high level; and if the data line signal of the previous column corresponding to the time when the current scan line is driven is first a low level and then a high level, the data line signal of the current column corresponding to the time when the current scan line is driven is first a high level and then a low level. At the same time, because the level is constantly changing, the excessive deflection of liquid crystal can be effectively avoided, so that the brightness display of the display panel is uniform.

In an embodiment, in the step of performing square wave conversion on the drive data to obtain data line signals, a high level and a low level on two adjacent data lines corresponding to the same scan line have the same starting order.

In this solution, the high level and the low level on the data lines have the same starting order. Corresponding to the same scan line, if the data line signal of the previous column corresponding to the time when the current scan line is driven is first a high level and then a low level, the data line signal of the current column corresponding to the time when the current scan line is driven is first a high level and then a low level; and if the data line signal of the previous column corresponding to the time when the current scan line is driven is first a low level and then a high level, the data line signal of the current column corresponding to the time when the current scan line is driven is first a low level and then a high level. At the same time, because the level is constantly changing, the excessive deflection of liquid crystal is avoided, and the display brightness of the display panel is uniform.

In an embodiment, in the step of performing square wave conversion on the drive data to obtain data line signals, corresponding square wave width time and reset time are queried and output from a preset square wave lookup table according to a target gray scale voltage value; the reset time determines the start time of the low level output, and the square wave width time determines the duration of the low level; and after the time of low level output is calculated, the square wave conversion is performed on the drive data to obtain the data line signals.

TABLE 1

Square wave lookup table

| Gray scale voltage | Data (8 bits) | POL | Square wave width time | Reset time |
|---|---|---|---|---|
| V255+ | 11111111 | H | T255 | Δt |
| . . . | . . . | H | . . . | . . . |
| . . . | . . . | H | . . . | . . . |
| V1+ | 00000001 | H | T1 | Δt |
| V0+ | 00000000 | H | T0 | Δt |
| V0− | 00000000 | L | T0' | Δt |
| V1− | 00000001 | L | T1' | Δt |
| . . . | . . . | L | . . . | . . . |
| . . . | . . . | L | . . . | . . . |
| V255− | 11111111 | L | T255' | Δt |

In this solution, in order that the time of low level output of square wave signals generated by different gray scale values and conversion of different gray scales can be better converted to each other to ensure the driving stability of the display panel, the square wave lookup table is adopted; through the conversion of the square wave lookup table, the time of low level output capable of driving target gray scales can be found, to achieve better display effect, instead of a digital-to-analog conversion method, saving the area of a chip on the display panel; in the square wave lookup table, different time of low level output corresponding to different gray scale values is queried and output through the query of the square wave width time and the reset time; because a previous frame inside a pixel has a residual voltage, the influence of the residual voltage inside the previous frame of the pixel can be avoided by resetting the square wave signal level to a highest level or a lowest level at the reset time, so that the correspondence of the square wave lookup table is more accurate; at the same time, the high level in the adopted square wave conversion method is constant and can be controlled by only a set of maximum voltage across reference voltages, which greatly lowers the design requirements for a peripheral circuit, and saves a production cost of the display panel. The square wave width time in this solution stores delay time. When the delay time is recorded in the square wave lookup table, a square wave width time number can be expressed in a certain basic clock period T.

In an embodiment, the step of performing square wave conversion on the drive data after the time of low level output of square wave signals is acquired, to obtain the data line signal includes:

performing logic operation: determining a gray scale voltage value by a polarity inversion setting signal to obtain a square wave waveform; performing table lookup conversion on the square wave waveform and the polarity inversion setting through a truth table to obtain a converted square wave waveform and obtain a logic waveform that needs to be output, and then performing level conversion and amplification through an amplifier to obtain the data line signals.

In this solution, after the time of low level output of square wave signals is obtained, an output logic waveform is obtained through rigorous logic calculation. Through logical calculation, it is ensured that the output logic waveform is accurate and correct, and the data line signals conforming to a target gray scale are obtained, so that the solution has a better implementation effect. In the process of square wave conversion, resetting to a low level or a high level is performed according to the polarity of polarity of polarity reversal signals; and when the high level potential of square wave signals obtained through logical calculation is small, the drive data output is not enough to drive the change of gray scales separately. After an analog low voltage of the logic waveform is converted, by level conversion, to an analog high voltage that can drive the display panel, the current drive capacity of the logic waveform is enhanced through an amplifier, so as to increase the power of the logic waveform, and the goal of smoothly driving the gray scale by the high level of the output square wave signal is achieved.

Figure 9:
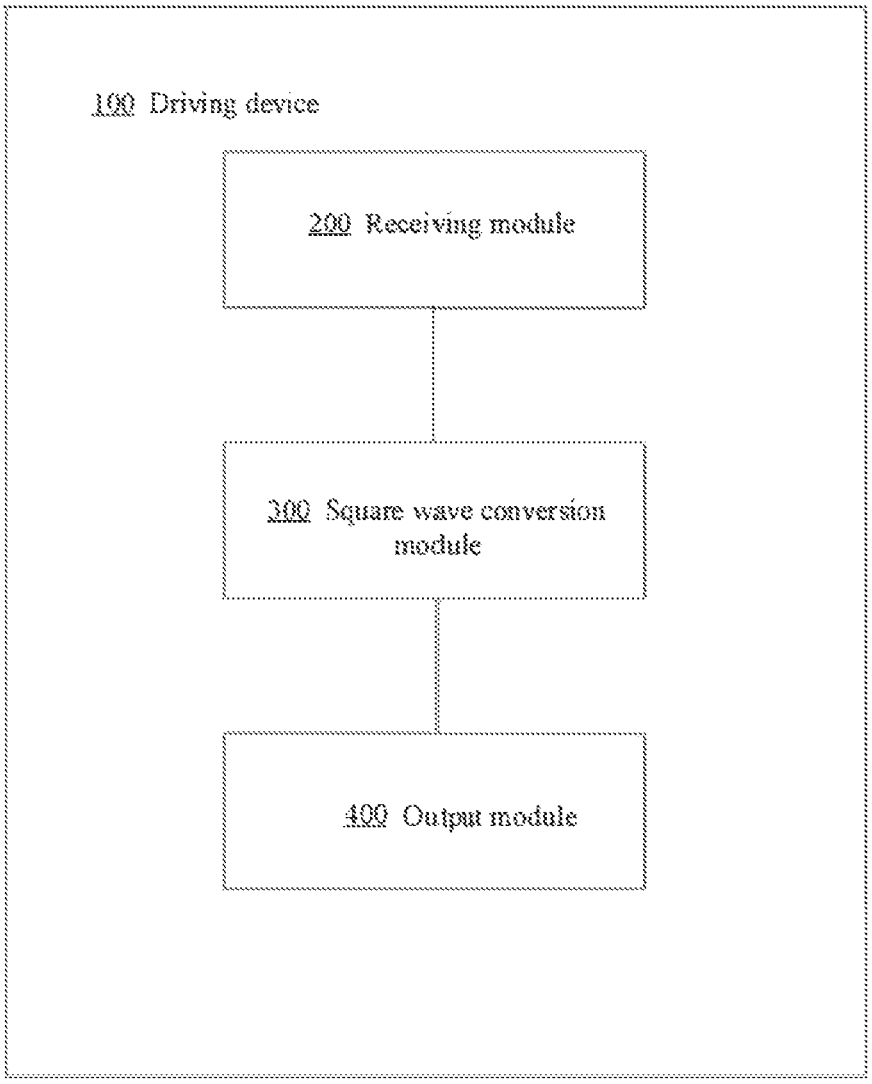
FIG. 9 is a schematic structural view of a driving device for a display panel according to an embodiment of the present application.

As another embodiment of the present application, referring to FIG. 9 and Table 2, a driving device 100 for a display panel is disclosed, including: a receiver 200 that receives drive data corresponding to each channel; a square wave conversion chip 300 that performs square wave conversion on the drive data to obtain data line signals; and an outputter 400 that outputs the data line signal corresponding to each channel, transmits the data line signal to a corresponding data line on the display panel 600, and performs data driving on the display panel 600;

where in the square wave conversion chip 300, square wave signals generated by the conversion of different gray scales in the corresponding drive data have an identical high level, and the time of high level output is different.

In an embodiment, the square wave conversion chip 300 includes an inverter circuit, and the inverter circuit includes:

a square wave generator (SWC), a polarity reversal chip (POL), a logic level power supply (VDD), and a result outputter (G1); the inverter circuit further includes a switch; the square wave generator (SWC) and the polarity reversal chip (POL) control the switch, and the switch controls the output of square wave signals; and input and output results of the square wave signals generate a truth table.

Figure 5:
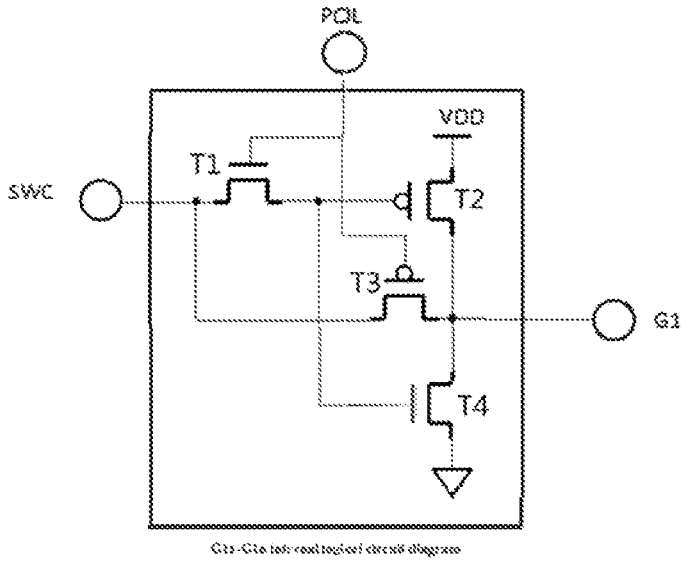
FIG. 5 is an inverter circuit view of a display panel according to an embodiment of the present application.
Figure 6:
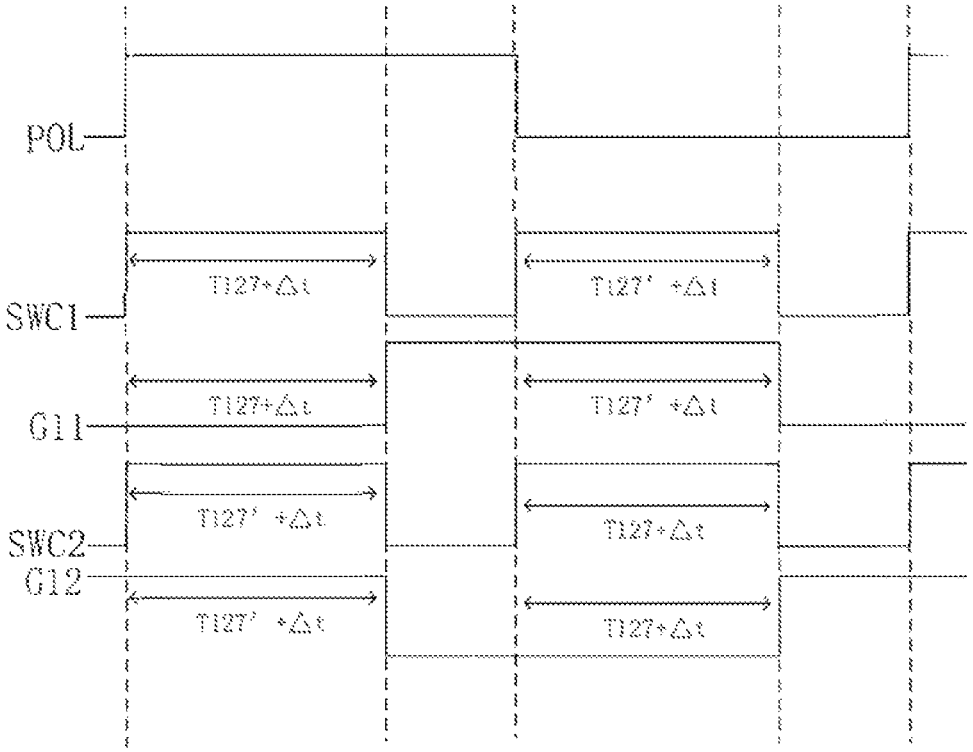
FIG. 6 is a schematic view of a square wave variation of a display panel according to an embodiment of the present application.
Figure 7:
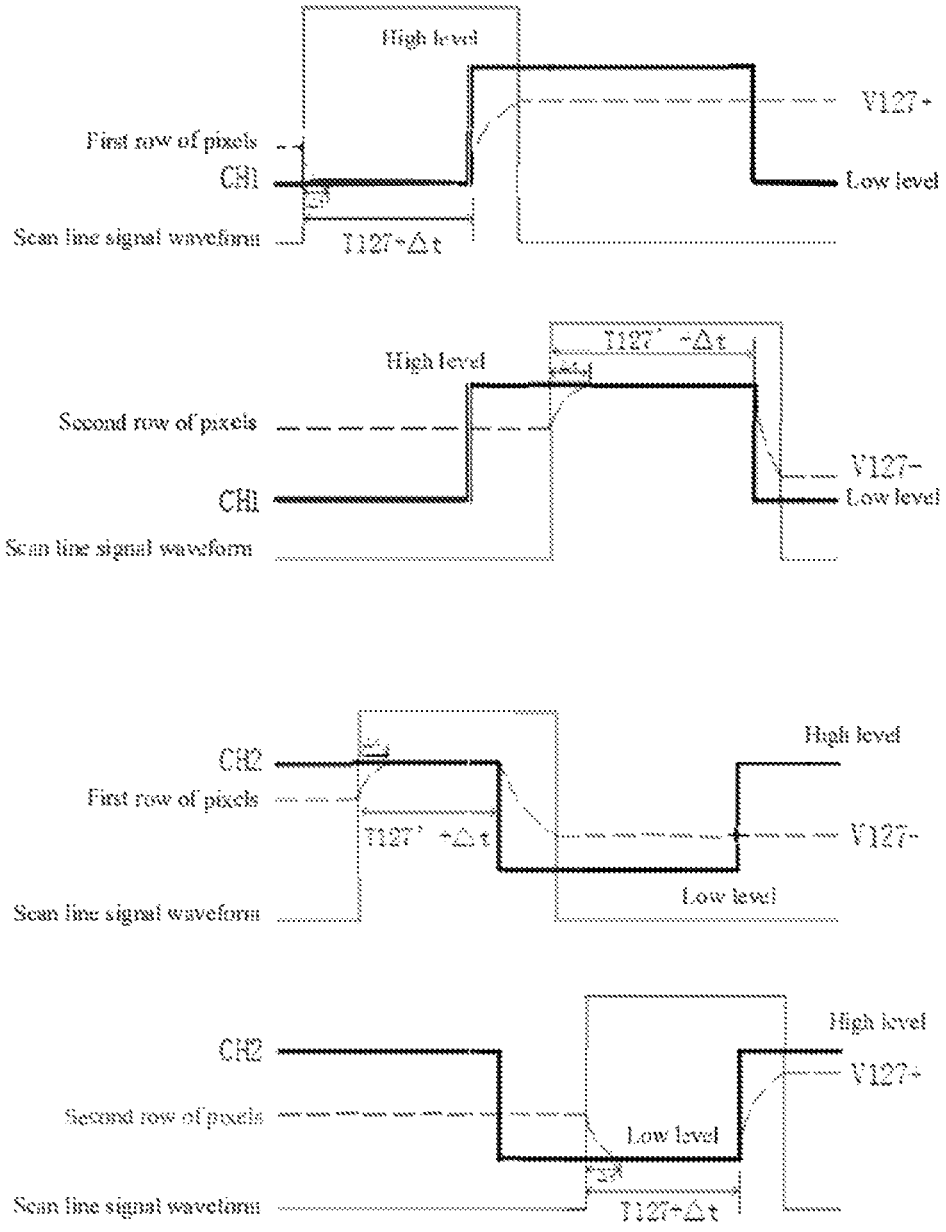
FIG. 7 is a view showing changes in pixel waveforms of a display panel according to an embodiment of the present application.
Figure 8:
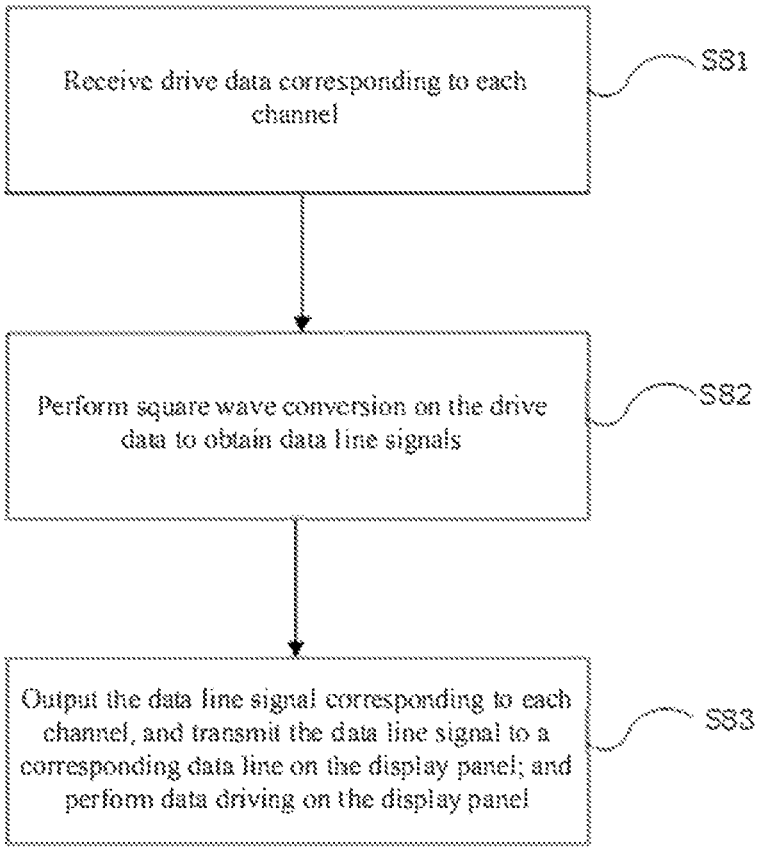
FIG. 8 is an application flow chart of a driving method for a display panel according to an embodiment of the present application.

As shown in FIG. 5 and Table 2, the switch includes four thin film transistors (TFTs), and the square wave generator (SWC) is a source of a first thin film transistor (T1) and a third thin film transistor (T3); the polarity reversal chip (POL) is a gate of the first thin film transistor (T1) and the third thin film transistor (T3), and the logic level power supply (VDD) is a source of a second thin film transistor (T2); a drain of the first thin film transistor (T1) is connected to a gate of the second thin film transistor (T2); a drain of the first thin film transistor (T1) is connected to a gate of a fourth thin film transistor (T4); a drain of the second thin film transistor (T2) is connected to a source of the fourth thin film transistor (T4), and the fourth thin film transistor (T4) is grounded;

when the polarity reversal chip (POL) inputs a high level, the first thin film transistor (T1) is turned on, and the third thin film transistor (T3) is turned off; when the square wave generator (SWC) inputs a high level, the fourth thin film transistor (T4) is turned on, and the second thin film transistor (T2) is turned off; the result outputter (G1) outputs a low level;

when the polarity reversal chip (POL) inputs a high level, the first thin film transistor (T1) is turned on, and the third thin film transistor (T3) is turned off; when the square wave generator (SWC) inputs a low level, the fourth thin film transistor (T4) is turned off, and the second thin film transistor (T2) is turned on; the result outputter (G1) outputs a high level;

when the polarity reversal chip (POL) inputs a low level and the square wave generator (SWC) inputs a high level, the first thin film transistor (T1) is turned off, the second thin film transistor (T2) is turned off, the third thin film transistor (T3) is turned on, and the fourth thin film transistor (T4) is turned off; the result outputter (G1) outputs a high level;

when the polarity reversal chip (POL) inputs a low level and the square wave generator (SWC) inputs a low level, the first thin film transistor (T1) is turned off, the second thin film transistor (T2) is turned off, the third thin film transistor (T3) is turned on, and the fourth thin film transistor (T4) is turned off; the result outputter (G1) outputs a low level;

that is, when the polarity reversal chip (POL) inputs a high level, the square wave signal output by the result outputter (G1) is equal to the square wave signal input by the square wave generator (SWC); and when the polarity reversal chip (POL) inputs a low level, the square wave signal output by the result outputter (G1) is equal to the square wave signal input by the square wave generator (SWC).

In this solution, according to the polarity reversal chip (POL), the square wave generator (SWC) and the four thin film transistors (TFTs) in the inverter circuit, the transmission of square wave signals is strictly controlled to prevent a fault from occurring in the square wave signal transmission and causing an erroneous, thereby obtaining required square wave signals while ensuring that the brightness of the display panel 600 is uniform.

TABLE 2

| Truth table | | |
|---|---|---|
| SWC | POL | G1 |
| H | H | L |
| L | H | H |
| H | L | H |
| L | L | L |

Figure 10:
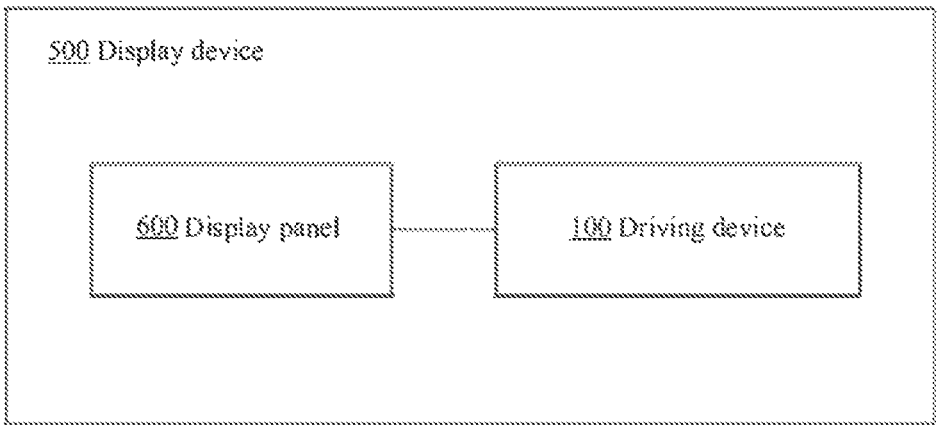
FIG. 10 is a schematic structural view of a display device according to an embodiment of the present application.

As another embodiment of the present application, referring to FIG. 10, a display device 500 is disclosed, including: a display panel 600 and the above-mentioned driving device 100, where after receiving a set of data signals, the driving device 100 outputs a set of data line signals by conversion, and transmits the set of data line signals to a set of corresponding data lines on the display panel 600; and the driving device controls a display state of the display panel 600 and performs data driving on the display device 500.

In the figure, this solution uses a forward-driven 127 gray scale (T127) and a negatively-driven negative 127 gray scale (T127') after reversal, a forward-driven 0 gray scale (T0) and a negatively-driven negative 0 gray scale (T0') after reversal as examples to illustrate the specific implementation contents. However, the solution includes, but is not limited to, 0 gray scale and 127 gray scale in actual operation.

It should be noted that it is not determined that the limitation of each step involved in this solution limits the sequence of steps on the premise of affecting the implementation of the specific solution. The previous steps may be performed first, or may also be executed later, or even executed at the same time, which should be considered as being within the scope of protection of the present application as long as this solution can be implemented.

The technical solution of the present application can be widely applied to flat panel displays such as a thin film transistor-liquid crystal display (TFT-LCD) and an organic light-emitting diode (OLED) display.

The above are further detailed descriptions of the present application in conjunction with the specific optional embodiments, but the specific implementation of the present application cannot be determined as being limited to these descriptions. For a person of ordinary skill in the art to which the present application pertains, a number of simple deductions or substitutions may also be made without departing from the concept of the present application. All these should be considered as falling within the scope of protection of the present application.

What is claimed is:

1. A driving method for a display panel, comprising steps of:

receiving drive data corresponding to each channel;

performing square wave conversion on the drive data to obtain data line signals; and outputting the data line signal corresponding to each channel, and transmitting the data line signal to a corresponding data line on the display panel; and performing data driving on the display panel;

in the step of performing square wave conversion on the drive data to obtain data line signals, square wave signals generated by the conversion of different gray scales in the corresponding drive data have an identical high level, and the time of low level output is different;

wherein in the step of performing square wave conversion on the drive data to obtain data line signals, a high level and a low level on the same data line corresponding to two adjacent scan lines have the same starting order;

wherein in the step of performing square wave conversion on the drive data to obtain data line signals, corresponding square wave width time and reset time are queried and output from a preset square wave lookup table according to a target gray scale voltage value; the reset time determines the start time of the low level output, and the square wave width time determines the duration of the low level; and after the time of low level output is calculated, the square wave conversion is performed on the drive data to obtain the data line signals.

2. The driving method for a display panel according to claim 1, wherein the step of performing square wave conversion on the drive data after the time of low level output of square wave signals is acquired, to obtain the data line signal comprises:

performing logic operation: determining a gray scale voltage value by a polarity inversion setting signal to obtain a square wave waveform; performing table lookup conversion on the square wave waveform and the polarity inversion setting through a truth table to obtain a converted square wave waveform and obtain a logic waveform that needs to be output, and then performing level conversion and amplification through an amplifier to obtain the data line signals.

3. The driving method for a display panel according to claim 1, wherein the step of performing square wave conversion on the drive data after the time of low level output of square wave signals is acquired, to obtain the data line signal comprises:

performing logic operation: determining a gray scale voltage value by a polarity inversion setting signal to obtain a square wave waveform; performing table lookup conversion on the square wave waveform and the polarity inversion setting through a truth table to obtain a converted square wave waveform and obtain a logic waveform that needs to be output, and then performing level conversion and amplification through an amplifier to obtain the data line signals.

4. A driving device for a display panel, comprising:

a receiver that receives drive data corresponding to each channel;

a square wave conversion chip that performs square wave conversion on the drive data to obtain data line signals; and an outputter that outputs the data line signal corresponding to each channel, transmits the data line signal to a corresponding data line on the display panel, and performs data driving on the display panel;

wherein in the square wave conversion chip, square wave signals generated by the conversion of different gray scales in the corresponding drive data have an identical high level, and the time of low level output is different;

wherein in the step of performing square wave conversion on the drive data to obtain data line signals, a high level and a low level on the same data line corresponding to two adjacent scan lines have the same starting order;

wherein the square wave conversion chip comprises an inverter circuit, and the inverter circuit comprises:

a square wave generator, a polarity reversal chip, a logic level power supply, and a result outputter; the inverter circuit further comprises a switch, the square wave generator and the polarity reversal chip control the switch, and the switch controls the output of square wave signals; and input and output results of the square wave signals generate a truth table.

* * * * *